US007086614B2

(12) United States Patent
Stier et al.

(10) Patent No.: US 7,086,614 B2
(45) Date of Patent: Aug. 8, 2006

(54) FUEL INJECTOR

(75) Inventors: Hubert Stier, Asperg (DE); Guenther Hohl, Stuttgart (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 130 days.

(21) Appl. No.: 10/110,290

(22) PCT Filed: Aug. 9, 2001

(86) PCT No.: PCT/DE01/02951

§ 371 (c)(1),
(2), (4) Date: Jul. 17, 2002

(87) PCT Pub. No.: WO02/12711

PCT Pub. Date: Feb. 14, 2002

(65) Prior Publication Data

US 2003/0047627 A1 Mar. 13, 2003

(30) Foreign Application Priority Data

Aug. 10, 2000 (DE) ..... 100 39 083

(51) Int. Cl.
*B05B 1/30* (2006.01)
*F02M 51/00* (2006.01)

(52) U.S. Cl. ..... 239/585.2; 239/585.5; 239/585.3; 239/600

(58) Field of Classification Search ..... 239/585.5, 239/585.3, 585.4, 585.2
See application file for complete search history.

(56) References Cited

U.S. PATENT DOCUMENTS

| | | | | |
|---|---|---|---|---|
| 5,687,698 | A * | 11/1997 | Mastro et al. | 123/568.26 |
| 5,704,553 | A * | 1/1998 | Wieczorek et al. | 239/585.1 |
| 5,884,850 | A * | 3/1999 | Norgauer | 239/585.5 |
| 5,915,626 | A * | 6/1999 | Awarzamani et al. | 239/135 |
| 5,996,911 | A * | 12/1999 | Gesk et al. | 239/585.1 |
| 6,079,642 | A * | 6/2000 | Maier | 239/585.1 |
| 6,508,418 | B1 * | 1/2003 | Fochtman et al. | 239/585.4 |
| 6,702,253 | B1 * | 3/2004 | Noller et al. | 251/129.21 |
| 6,808,133 | B1 * | 10/2004 | Stier | 239/585.1 |

FOREIGN PATENT DOCUMENTS

| | | |
|---|---|---|
| DE | 37 38 558 | 7/1988 |
| DE | 195 46 361 | 7/1996 |
| DE | 196 26 576 | 1/1998 |
| DE | 037 38 558 | 7/1998 |
| DE | 199 48 238 | 4/2001 |
| RU | 2 029 129 | 2/1995 |
| RU | 2 152 533 | 7/2000 |
| SU | 1 738 097 | 5/1992 |
| WO | WO 00 28205 | 5/2000 |

* cited by examiner

*Primary Examiner*—David A. Scherbel
*Assistant Examiner*—James S. Hogan
(74) *Attorney, Agent, or Firm*—Kenyon & Kenyon LLP

(57) ABSTRACT

A fuel injector is described for fuel injection systems in internal combustion engines that includes a magnet coil, an armature that is acted upon in a closing direction by a restoring spring, and a valve needle that is non-positively engaged with armature for actuating a valve closing body, which together with a valve seat surface forms a sealing seat, and armature with an inlet-side armature surface striking internal pole. A choke point is provided on inlet-side armature surface, and is formed by an annular, stepped prominence on inlet-side armature surface.

5 Claims, 3 Drawing Sheets

FUEL INJECTOR

FIELD OF THE INVENTION

The present invention relates to a fuel injector.

BACKGROUND INFORMATION

German Patent Application No. 196 26 576 describes a fuel injector having a choke-like narrowing in the area of the magnet armature. The fuel may be fed in such a manner that it flows through the choke-like narrowing with a flow component directed away from the injection orifice. This may cause an at least partially compensating counterforce to be exerted on the valve needle or on the armature which may be non-positively connected to the valve needle.

The fuel injector described in the above-cited document may involve a complicated construction, which may entail considerable effort in manufacturing the components.

Moreover, it may not be possible to optimize the closing times in the fuel injector described above by targeted use of the fuel back pressure acting on the armature, so that the opening times of the fuel injector may also need improvement, since the restoring spring may need to possess a strong closing force in order to seal the fuel injector against the pressure of the combustion chamber.

Conventional fuel injectors may be provided with spiral flutes or swirl boreholes in the region of the metering point. The choking of the fuel flow in the area of these flutes or swirl boreholes may result in a force component acting on the valve needle in the direction of closure. This may adversely affect the valve behavior.

SUMMARY

A fuel injector according to the present invention may use hydraulic forces to shorten the closing time of the fuel injector, since the choke point arranged between the armature and the internal pole may cause a small buildup of back pressure on the armature. Furthermore, as a result of the hydraulic forces acting on the armature stop by damping, rebound behavior may be improved during the opening operation.

Refinements of the fuel injector may be possible.

A prominence at the choke point may include a wedge shape to prevent hydraulic adhesion of the armature to the stop.

Boreholes used for dechoking may be placed simply at the desired location in the armature.

Dechoking may be easily performed via the center cutaway in the armature, since the center cutaway may be drilled with a slightly larger diameter when the armature is manufactured.

The prominence may be formed on the armature stop surface of the internal pole, since in this manner the shape of the armature may not need to be changed.

A shoulder on the outflow surface of the internal pole may be provided as a choke point, since this example embodiment may be particularly easily manufactured.

DETAILED DESCRIPTION

Figure 1:
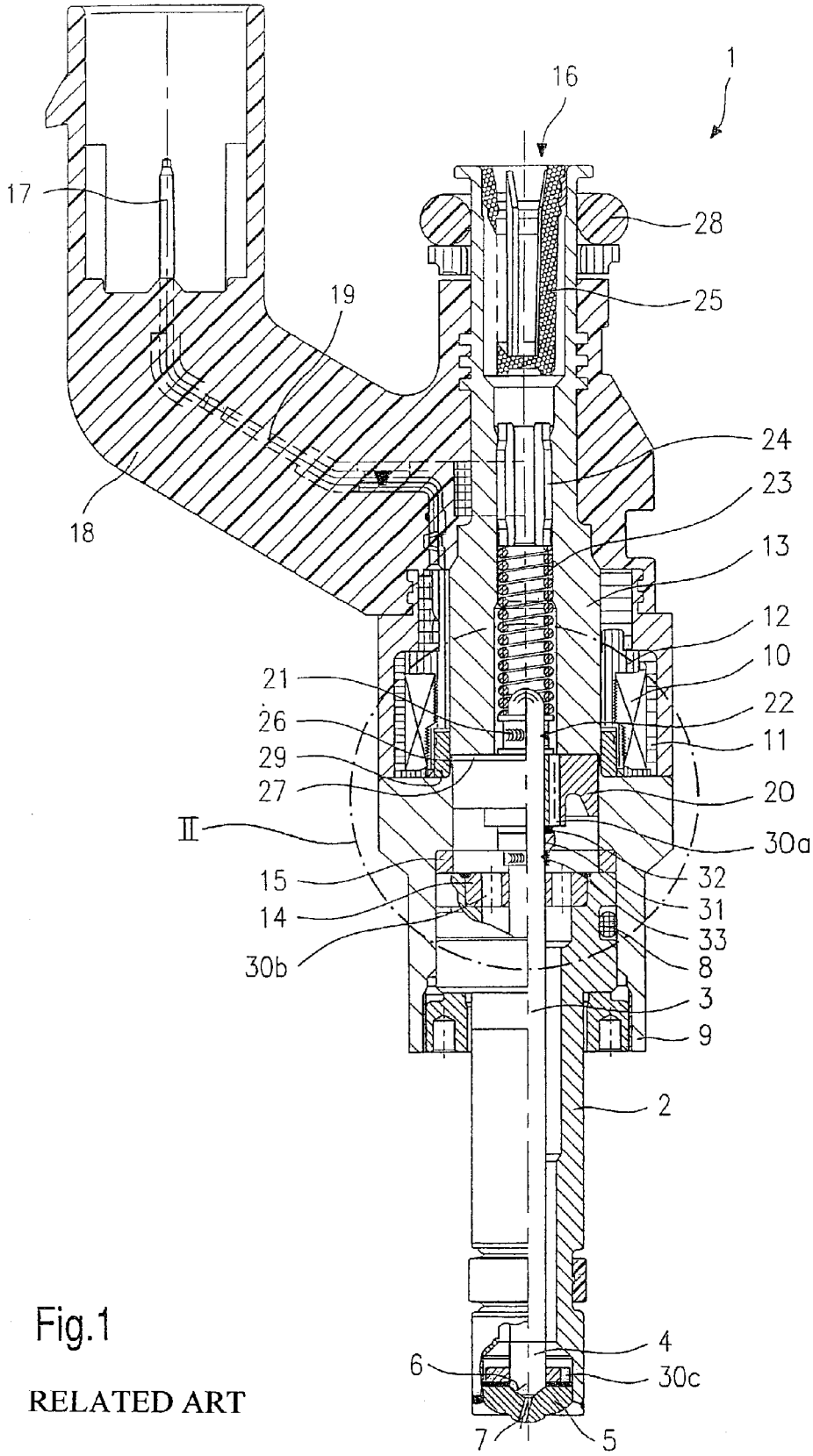
Fig.1 RELATED ART
FIG. 1 shows a schematic section of a conventional fuel injector.

Before proceeding with a detailed description of the fuel injector 1 according to the present invention with reference to FIGS. 2 and 3A–C, a better understanding of the present invention will be served by a short explanation with reference to FIG. 1 of the essential components of a conventional fuel injector 1 that may be similar in its construction to the example embodiments with the exception of the inventive measures of the present invention.

Fuel injector 1 may be configured in the form of a fuel injector for fuel injection systems of mixture compressing, externally ignited internal combustion engines. Fuel injector 1 may be suited for direct injection of fuel into a combustion chamber of an internal combustion engine.

Fuel injector 1 includes a nozzle body 2 in which a valve needle 3 is guided. Valve needle 3 is mechanically linked with valve closing body 4, which cooperates with valve seat surface 6 arranged on valve seat body 5 to form a sealing seat. Fuel injector 1 is an inwardly opening fuel injector 1, having an injection orifice 7. Nozzle body 2 is sealed off from external pole 9 of magnet coil 10 by seal 8. Magnet coil 10 is contained in coil housing 11 and wound around insulating frame 12, which is in contact with an internal pole 13 of magnet coil 10. Internal pole 13 and external pole 9 are isolated from one another magnetically and are supported on connecting component 29. Magnet coil 10 is excited by an electrical current which may be supplied via line 19 via electrical contact plug 17. Contact plug 17 is enclosed by plastic mantle 18, which may be sprayed on internal pole 13.

Valve needle 3 is seated in valve needle guide 14, which is disk-shaped. Matched adjusting disk 15 is used for lift adjustment. On the other side of adjusting disk 15 is an armature 20. This is connected non-positively with valve needle 3 via first flange 21, valve needle 3 being connected to first flange 21 by welded seam 22. A first flange 21 supports a restoring spring 23, which in this configuration of fuel injector 1 is pre-tensioned by bush 24.

A second flange 31, which is connected to valve needle 3 via a welded seam 33, is used as the bottom armature stop. An elastic intermediate ring 32, which rests on top of second flange 31, prevents rebounding when fuel injector 1 closes.

Fuel channels 30*a* to 30*c* are arranged in valve needle guide 14, in armature 20, and on valve seat body 5. These channels supply the fuel, which is fed via central fuel supply 16 and filtered through filter element 25, to injection orifice 7. Fuel injector 1 is sealed off from a fuel line by seal 28.

In the rest position of fuel injector 1, armature 20 is forced against its lift direction by restoring spring 23, such that valve closing body 4 is held in a sealing position in valve seat 6. When magnet coil 10 is excited, it creates a magnetic field that moves armature 20 against the spring force of restoring spring 23 in the direction of the lift, the lift being predetermined by working gap 27 which is located between internal pole 13 and armature 20 in the rest position. Armature 20 also moves flange 21, which is welded to valve needle 3, in the direction of the lift. Valve closing body 4, which is mechanically linked to valve needle 3, lifts off from valve seat surface 6 and the fuel that is fed through fuel channels 30*a* to 30*c* to injection orifice 7 is injected.

After the coil current is switched off, armature 20 drops away from internal pole 13 under the pressure of restoring spring 23 when the magnetic field has been sufficiently reduced, so that flange 21 which is mechanically linked to valve needle 3 moves against the direction of the lift. Valve needle 3 is thereby moved in the same direction, so that valve closing body 4 comes to rest on valve seat surface 6 and fuel injector 1 is closed.

Figure 2:
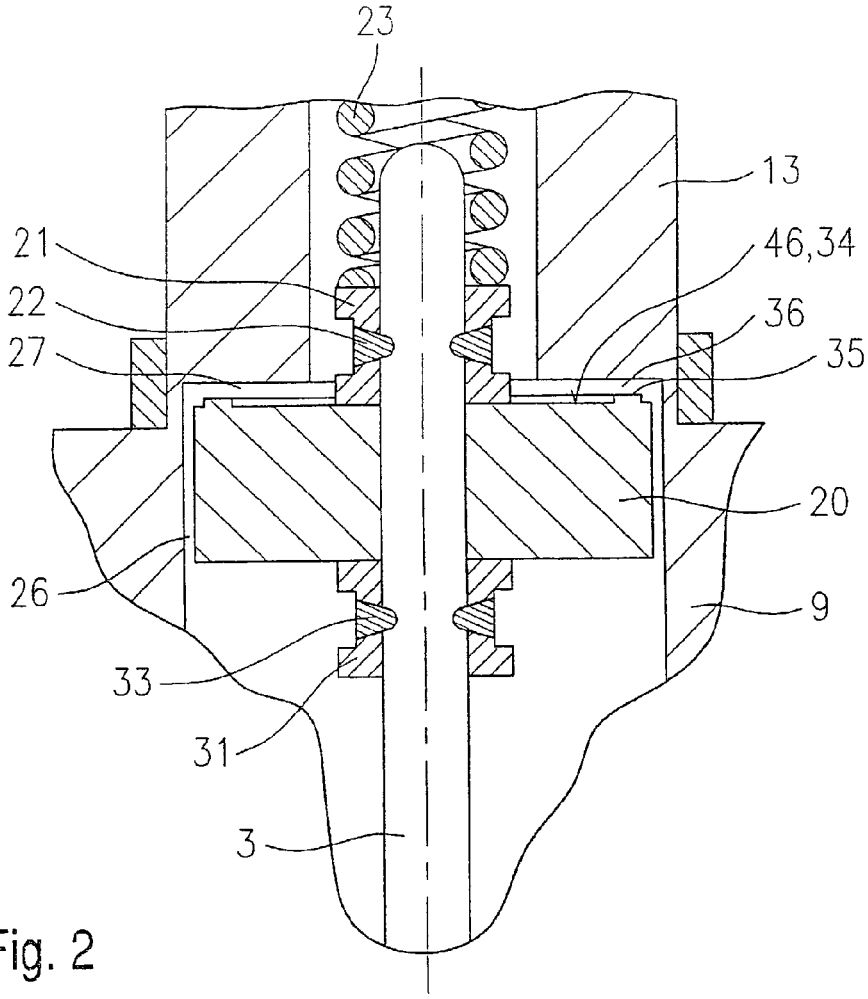
FIG. 2 shows a schematic partial cutaway section through a first example embodiment of a fuel injector according to the present invention, in the area II indicated in FIG. 1.

FIG. 2 shows in a partial cutaway section a first exemplary embodiment of a fuel injector 1 according to the present invention. The section described is indicated in FIG. 1 by II.

FIG. 2 shows the area surrounding armature 20, which is supported on second flange 31, shown in simplified form, when fuel injector 1 is in the rest position. Second flange 31 is mechanically linked to valve needle 3 via welded seam 33. First flange 21, which supports restoring spring 23, is located on the supply side of armature 20. First flange 21 is also mechanically linked to valve needle 3 via a welded seam 22.

To provide the restriction of the fuel flow around armature 20 according to the present invention, a small stepped prominence 35 is formed on an inlet-side armature surface 34. Prominence 35 runs in the shape of a ring on inlet-side armature surface 34. In this manner, the fuel flow about armature 20 is restricted. The degree to which the restriction occurs may depend among other things on surface 46 enclosed by prominence 35. The choking effect at choke point on prominence 35 may enhance the existing restriction effect that is caused by lateral choke gap 26 at the external lateral surface of the mantle of armature 20.

The restriction of fuel flow may result in a small buildup of dynamic pressure on armature 20. As a consequence of this dynamic pressure, armature 20 may disengage from internal pole 13 more quickly when the coil current exciting magnet coil 10 is switched off. This may be enhanced by the reduction of the armature stop surface, which is limited to prominence 35. The adhesive forces between armature 20 and internal pole 13 may thus be reduced. Together, these two effects may result in a shorter valve closing time. In turn, this may be used to reduce the dimensions of restoring spring 23. This again may result in improved opening behavior of fuel injector 1, since the magnetic force that acts against the force of restoring spring 23 may more easily draw armature 20 towards internal pole 13.

The height of prominence 35 is exaggerated in FIG. 2.

Prominence 35 includes a rectangular or slightly wedge-shaped profile, in order to prevent hydraulic adhesion of armature 20 to internal pole 13. The effects described may be achieved with a prominence 35 of no more than a few μm above the otherwise flat inlet-side armature surface 34. Various manufacturing processes may be possible for prominence 35, such as vacuum deposition of a layer of metal or countersinking a depression in inlet-side armature surface 34.

The operation of fuel injector 1 having a choke point 36 of such kind may be subject to relatively strong fluctuations. The choking effect may strongly influenced by geometric, hydraulic and thermal parameters, since, for example, the viscosity, and therewith the flow rate of the fuel, may both be affected by the temperature. Accordingly, the system may exhibit a variety of operating states. For example, if the hydraulic damping is so strong that armature 20 may not strike internal pole 13, the operation is ballistic. From the point of view of the dynamics, this may be a desirable operating state, but it may be difficult to control. If armature 20 strikes internal pole 13 in a delayed manner, the opening time of fuel injector 1 is extended.

In order to minimize the interference parameters, the system may be specifically dechoked. The choking effect may be reduced by boreholes in armature 20, thereby reducing the hydraulic closing force. If dechoking is performed adequately, the operation of the system becomes non-ballistic.

Figure 3C:
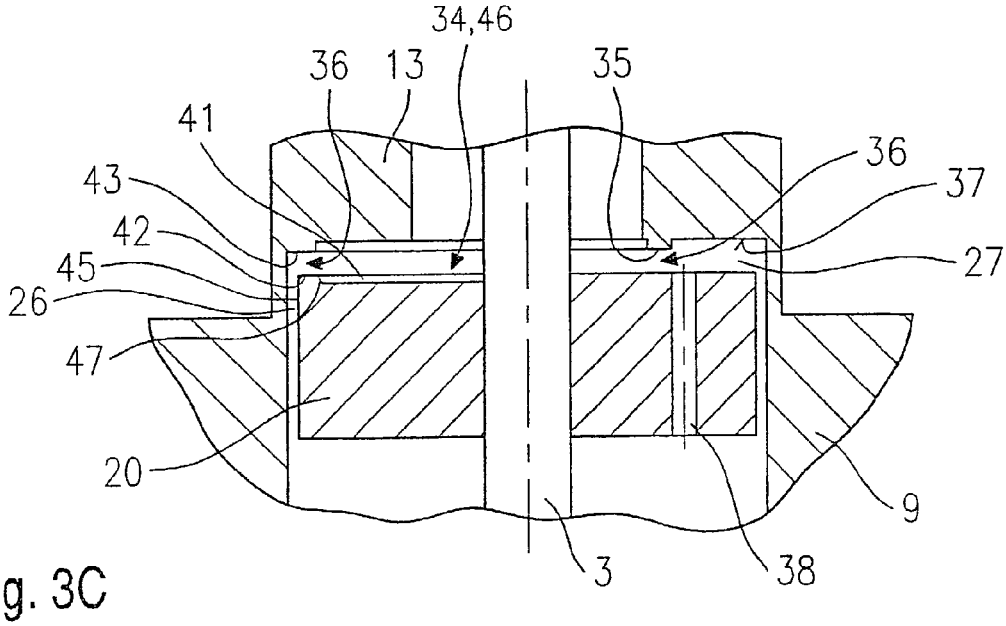
FIG. 3C shows a schematic section of a fifth and a sixth example embodiment of a fuel injector according to the present invention with stop dechoking.
Figure 3A:
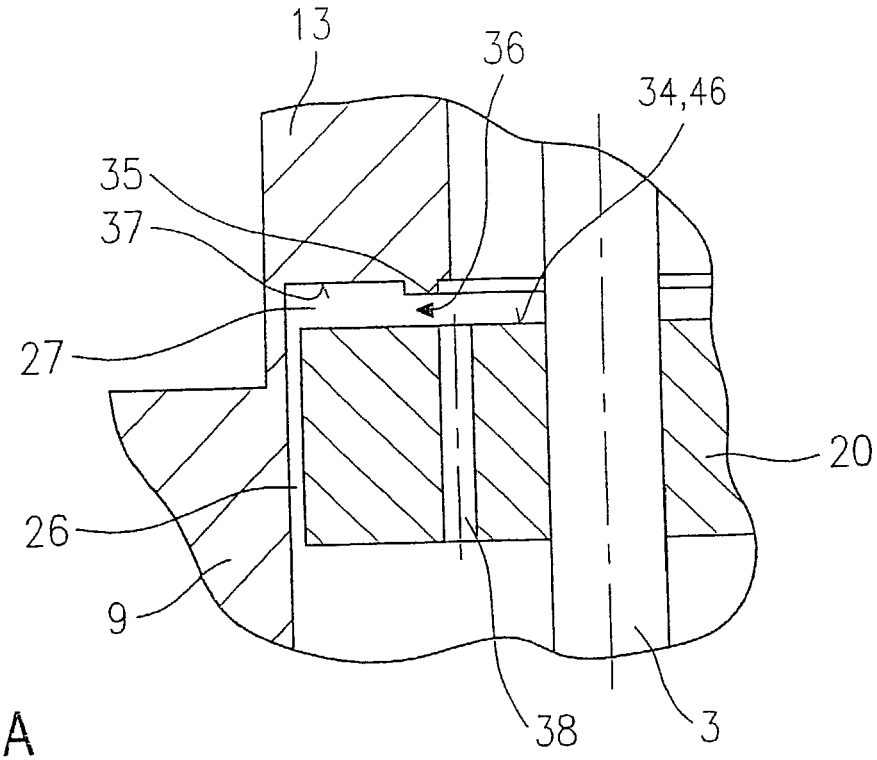
FIG. 3A shows a schematic sectional view of a second example embodiment of a fuel injector according to the present invention having boreholes for dechoking.

FIG. 3A shows a schematic partial section of second example embodiment of fuel injector 1 according to the present invention. In this case, prominence 35 is not attached to inlet-side armature surface 34, but to an outlet-side armature stop surface 37 of internal pole 13. As long as the distance between choke point 36 and valve needle 3 or the area 46 enclosed by prominence 35 remains the same, the effect of the dynamic pressure may also be unchanged.

A borehole 38 is provided in armature 20 for targeted reduction of the choking effect. Borehole 38 is located within the area enclosed by annular prominence 35, so that the choking effect resulting from the smaller quantity of fuel flowing through choke point 36 may be reduced. In this manner, interference factors are minimized, but at the same time, it may be still possible to utilize the hydraulic force on inlet-side armature surface 34.

Figure 3B:
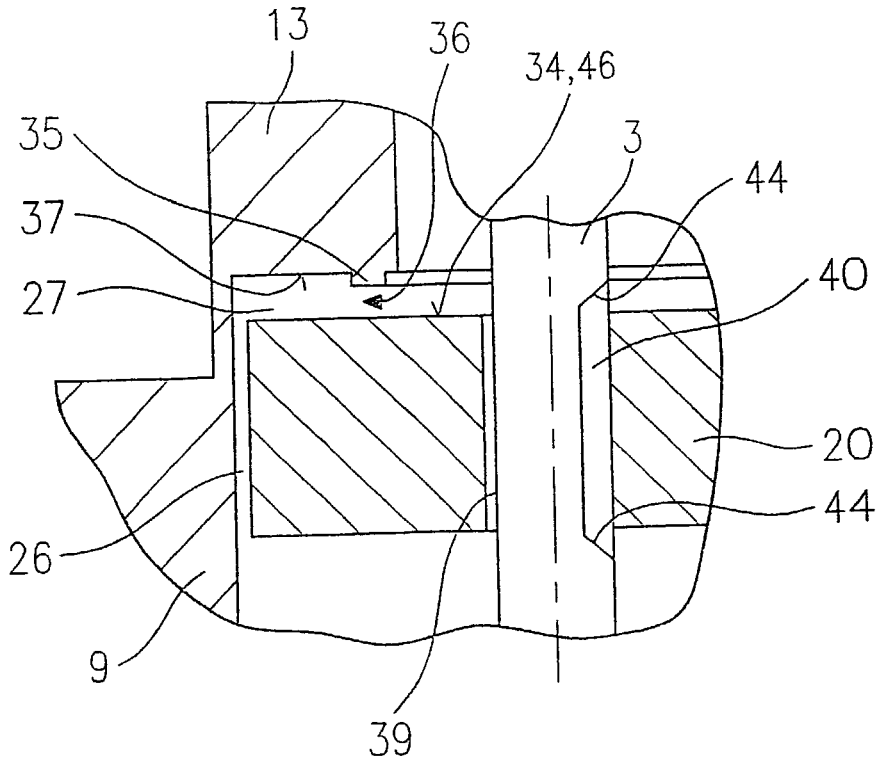
FIG. 3B shows a schematic sectional view of a third and a fourth example embodiment of a fuel injector according to the present invention having boreholes for dechoking.

In a view similar to FIG. 3A, FIG. 3B shows a third and a fourth example embodiment for targeted dechoking of the system.

Thus, the dechoking measure that in the previous example embodiment took the form of borehole 38 may also be implemented as a groove-like widening of a center cutaway 39 of armature 20, as shown in the area to the left of valve needle 3 in FIG. 3B. In this example embodiment, the dechoking groove may be produced without major effort using center cutaway 39 of armature 20, and without the need to provide additional boreholes 38 in armature 20.

The fourth example embodiment, shown on the right in FIG. 3B, also includes the form of a groove-like cutaway 40 in valve needle 3. This example embodiment may be easily manufactured. For example, cutaway 40 may be provided in valve needle 3 by turning or milling, particularly with hydrodynamically favorable rounded edges 44.

FIG. 3C shows a schematic partial section of a fifth and a sixth example embodiment of fuel injector 1 according to the present invention, each having a "stop dechoking" device.

In the example embodiment shown on the left in FIG. 3C, armature 20 is configured so that a recess 41, e.g., in the form of a radially extending groove, is provided on inlet-side armature surface 34, and the groove is closed by a marginally projecting prominence 42, which extends annularly along an outer edge 45 of inlet-side armature surface 34. The choking effect of choke point 36 that is created between marginally projecting prominence 42 and a shoulder 43 of internal pole 13 corresponding thereto is lessened by an amount dependent on the length of recess 41. Here too, an edge 47 facing recess 41 is chamfered or rounded to favor the flow.

In this manner, the length of choke gap 36 at armature stop 42, 43 may be reduced without significant reduction to surface 46, which may influence the dynamic pressure. During operation, this arrangement may tend to remain in the ballistic area.

A sixth example embodiment of fuel injector 1 according to the present invention is shown on the right in FIG. 3C. This is also furnished with a stop dechoking device.

In principle, this example embodiment is similar to that described in FIG. 3A, except that borehole 38 is not located inside annular prominence 35, but is rather moved radially toward the outer perimeter of armature 20. This again may further reduce the length of choke gap 36.

The present invention is not limited to the example embodiments shown, and may also be implemented in a wide range of designs of fuel injectors.

What is claimed is:

1. A fuel injector for a fuel injection system in a internal combustion engine, comprising:

a magnet coil;

an internal pole including an outlet-side armature stop surface, said internal pole including a shoulder arranged on the outlet-side armature stop surface;

an armature including an inlet-side armature surface, the armature configured to strike the internal pole with the inlet-side armature surface;

an annular stepped prominence arranged on at least one of the inlet-side armature surface and the outlet-side armature stop surface, the annular stepped prominence forming a choke point;

a restoring spring configured to act upon the armature in a closing direction;

a valve closing body;

a valve needle that is non-positively engaged with the armature for actuating the valve closing body;

a valve seat surface; and a sealing seat formed by the valve closing body and the valve seat surface.

2. The fuel injector according to claim 1, further comprising:

a dechoking arrangement arranged on the armature close to the choke point.

3. The fuel injector according to claim 1, wherein the annular stepped prominence includes one of a rectangular shape and a wedge-like shape.

4. The fuel injector according to claim 1, wherein the armature includes a borehole to reduce a choking effect of the choke point.

5. The fuel injector according to claim 4, wherein the borehole is applied within an area enclosed by the annular stepped prominence.

* * * * *